US007870994B2

(12) United States Patent
Spivey, Sr. et al.

(10) Patent No.: US 7,870,994 B2
(45) **Date of Patent: *Jan. 18, 2011**

(54) CARTON WITH DISPENSER

(75) Inventors: Raymond Rudolph Spivey, Sr., Mableton, GA (US); Jean-Manuel Gomes, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 981 days.

This patent is subject to a terminal disclaimer.

(21) Appl. No.: 11/622,589

(22) Filed: Jan. 12, 2007

(65) Prior Publication Data

US 2007/0164093 A1 Jul. 19, 2007

Related U.S. Application Data

(60) Provisional application No. 60/758,365, filed on Jan. 12, 2006.

(51) Int. Cl.
*B65D 5/00* (2006.01)
*B65D 17/00* (2006.01)

(52) U.S. Cl. ..... 229/122; 229/242

(58) Field of Classification Search ..... 229/117.16, 229/117.14, 117.13, 116.1, 922; 206/736, 206/139, 141, 155; 220/DIG. 13
See application file for complete search history.

(56) References Cited

U.S. PATENT DOCUMENTS

| | | | | |
|---|---|---|---|---|
| 2,115,673 | A | | 4/1938 | Stompe |
| 3,178,242 | A | | 4/1965 | Ellis et al. |
| 3,356,279 | A | | 12/1967 | Root |
| 4,396,143 | A | | 8/1983 | Killy |
| 4,417,655 | A | | 11/1983 | Forbes, Jr. |
| 4,577,762 | A | | 3/1986 | Kuchenbecker |
| 4,588,084 | A | * | 5/1986 | Holley, Jr. ..... 206/427 |
| 4,634,007 | A | | 1/1987 | Rusnock |
| 4,850,529 | A | | 7/1989 | Blackman |
| 4,890,440 | A | | 1/1990 | Romagnoli |
| 4,949,845 | A | | 8/1990 | Dixon |
| 4,974,771 | A | | 12/1990 | Lavery |
| 5,137,211 | A | | 8/1992 | Summer et al. |

(Continued)

FOREIGN PATENT DOCUMENTS

| | | |
|---|---|---|
| DE | 29 17 795 | 8/1980 |

(Continued)

*Primary Examiner*—Nathan J Newhouse
*Assistant Examiner*—Christopher Demeree
(74) *Attorney, Agent, or Firm*—Womble Carlyle Sandridge & Rice, PLLC

(57) ABSTRACT

A carton for containing a plurality of articles and a blank for forming such carton. The carton has panels that extend at least partially around an interior of the carton. The panels comprise a top panel, a bottom panel, a first side panel, and a second side panel. At least two end flaps are respectively foldably attached to respective panels of the plurality of panels. The end flaps at least partially form a closed end of the carton. A dispenser allows access to the articles in the carton and includes a dispenser panel that is at least partially defined by a tear line in the carton. The dispenser panel is for being at least partially removed for at least further opening a dispenser opening in the closed end. The closed end of the carton comprises an end wall that angles inward toward the interior of the carton.

22 Claims, 5 Drawing Sheets

U.S. PATENT DOCUMENTS

| | | | | |
|---|---|---|---|---|
| 5,246,112 | A | 9/1993 | Stout et al. | |
| 5,320,277 | A * | 6/1994 | Stout et al. | 229/117.13 |
| 5,360,113 | A | 11/1994 | Harris | |
| 5,505,372 | A | 4/1996 | Edson et al. | |
| 5,622,309 | A | 4/1997 | Matsuda et al. | |
| 5,664,683 | A | 9/1997 | Brody | |
| 5,690,213 | A | 11/1997 | Matsumura | |
| 5,704,470 | A | 1/1998 | Sutherland | |
| 5,826,783 | A | 10/1998 | Stout | |
| 5,875,961 | A | 3/1999 | Stone et al. | |
| 5,921,398 | A | 7/1999 | Carroll | |
| 5,924,559 | A | 7/1999 | Carrel et al. | |
| 6,155,480 | A * | 12/2000 | Botsford et al. | 229/122.1 |
| 6,176,419 | B1 | 1/2001 | Holley, Jr. | |
| 6,227,367 | B1 | 5/2001 | Harrelson et al. | |
| 6,402,021 | B1 | 6/2002 | Heathcock | |
| 6,409,077 | B1 | 6/2002 | Telesca et al. | |
| 6,631,803 | B2 | 10/2003 | Rhodes et al. | |
| 6,715,639 | B2 | 4/2004 | Spivey | |
| 6,752,262 | B1 | 6/2004 | Boriani et al. | |
| 6,834,793 | B2 | 12/2004 | Sutherland | |
| 6,866,186 | B2 | 3/2005 | Fogle et al. | |
| 7,066,379 | B2 | 6/2006 | McLeod et al. | |
| 7,204,406 | B2 | 4/2007 | Bone | |
| 2002/0070139 | A1 | 6/2002 | Bates | |
| 2002/0088820 | A1 | 7/2002 | Spivey | |
| 2002/0088821 | A1 | 7/2002 | Spivey et al. | |
| 2004/0060972 | A1 | 4/2004 | Harrelson | |
| 2004/0099558 | A1 | 5/2004 | Oliff et al. | |

FOREIGN PATENT DOCUMENTS

| | | | |
|---|---|---|---|
| DE | 202 06 426 | U1 | 9/2002 |
| EP | 0 475 147 | A1 | 3/1992 |
| EP | 1 262 417 | A2 | 12/2002 |
| FR | 2 441 550 | | 11/1978 |
| FR | 2 549 010 | A1 | 1/1985 |
| FR | 2 581 970 | | 11/1986 |
| GB | 1 420 024 | | 1/1976 |
| WO | WO 96/29260 | | 9/1996 |
| WO | WO 99/64301 | | 12/1999 |
| WO | WO 02/30785 | A1 | 4/2002 |
| WO | WO 2004/002837 | A2 | 1/2004 |
| WO | WO 2004/043790 | A2 | 5/2004 |
| WO | WO 2005/080218 | A1 | 9/2005 |

* cited by examiner

CARTON WITH DISPENSER

CROSS-REFERENCE TO RELATED APPLICATION

This application claims the benefit of U.S. Provisional Application No. 60/758,365, filed on Jan. 12, 2006, the entire contents of which are hereby incorporated by reference as if presented herein in their entirety.

BACKGROUND OF THE INVENTION

The present invention generally relates to cartons for holding and dispensing beverage containers or other types of articles. More specifically, the present invention relates to cartons having a dispenser for dispensing articles from the carton.

Enclosed cartons with dispensing features have been used in the past. Many such cartons allow for the creation of dispenser openings by providing dispenser portions demarcated by tear lines. The dispenser portions can be wholly or partially separated from the carton to create an opening from which articles can be removed from the carton. Many conventional dispenser openings, however, are positioned such that the removable dispenser panel prevents the carton from being easily carried after the dispenser panel has been removed.

SUMMARY OF THE INVENTION

In general, one aspect of the invention is directed to a carton containing a plurality of containers. The carton comprises a plurality of panels extending at least partially around an interior of the carton, the plurality of panels including at least a top panel. Opposite first and second end panels respectively at least partially close opposite ends of the carton. A handle is positioned in the second end panel and is for use in carrying the carton. At least a portion of the first end panel extends downwardly from the top panel at a first angle so that a first distance is defined between an upper edge of the first end panel and tops of containers of the plurality of containers that are adjacent to the upper edge of the first end panel. At least a portion of the second end panel extends downwardly from the top panel at a second angle so that a second distance is defined between an upper edge of the second end panel and tops of adjacent containers of the plurality of containers that are adjacent to the upper edge of the second end panel. The second angle is less than the first angle so that the second distance is greater than the first distance and a distance is defined between the handle and at least one container of the plurality of containers that is adjacent to the handle. The distance between the handle and the at least one adjacent container is for facilitating ease of use of the handle.

In another aspect, the invention is generally related to a carton for containing a plurality of articles. The carton comprises panels that extend at least partially around an interior of the carton, the panels comprise a top panel, a bottom panel, a first side panel, and a second side panel. At least two end flaps respectively foldably attached to respective panels of the plurality of panels, wherein the end flaps at least partially form a closed end of the carton. A dispenser for allowing access to the articles in the carton. The dispenser comprises a dispenser panel that is at least partially defined by a tear line in the carton and is for being at least partially removed for at least further opening a dispenser opening in the closed end. The closed end of the carton comprises an end wall that angles inward toward the interior of the carton.

In another aspect, the invention is generally directed to a blank for forming a carton for containing a plurality of articles. The blank comprises a plurality of panels comprising a top panel, a bottom panel, a first side panel, and a second side panel. At least two end flaps respectively foldably attached to respective panels of the plurality of panels. The end flaps are for forming a closed end of the carton formed from the blank. A dispenser panel is at least partially defined by a tear line in the blank and is for being at least partially removed for at least further opening a dispenser opening in the carton formed from the blank. The at least two end flaps are for forming an end wall that angles inward from the bottom panel to the top panel.

Other aspects, features, and details of the present invention can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present invention generally relates to opening, dispensing, and handling features for cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present invention can accommodate articles of any shape. For the purpose of illustration and not for the purpose of limiting the scope of the invention, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

Figure 1:
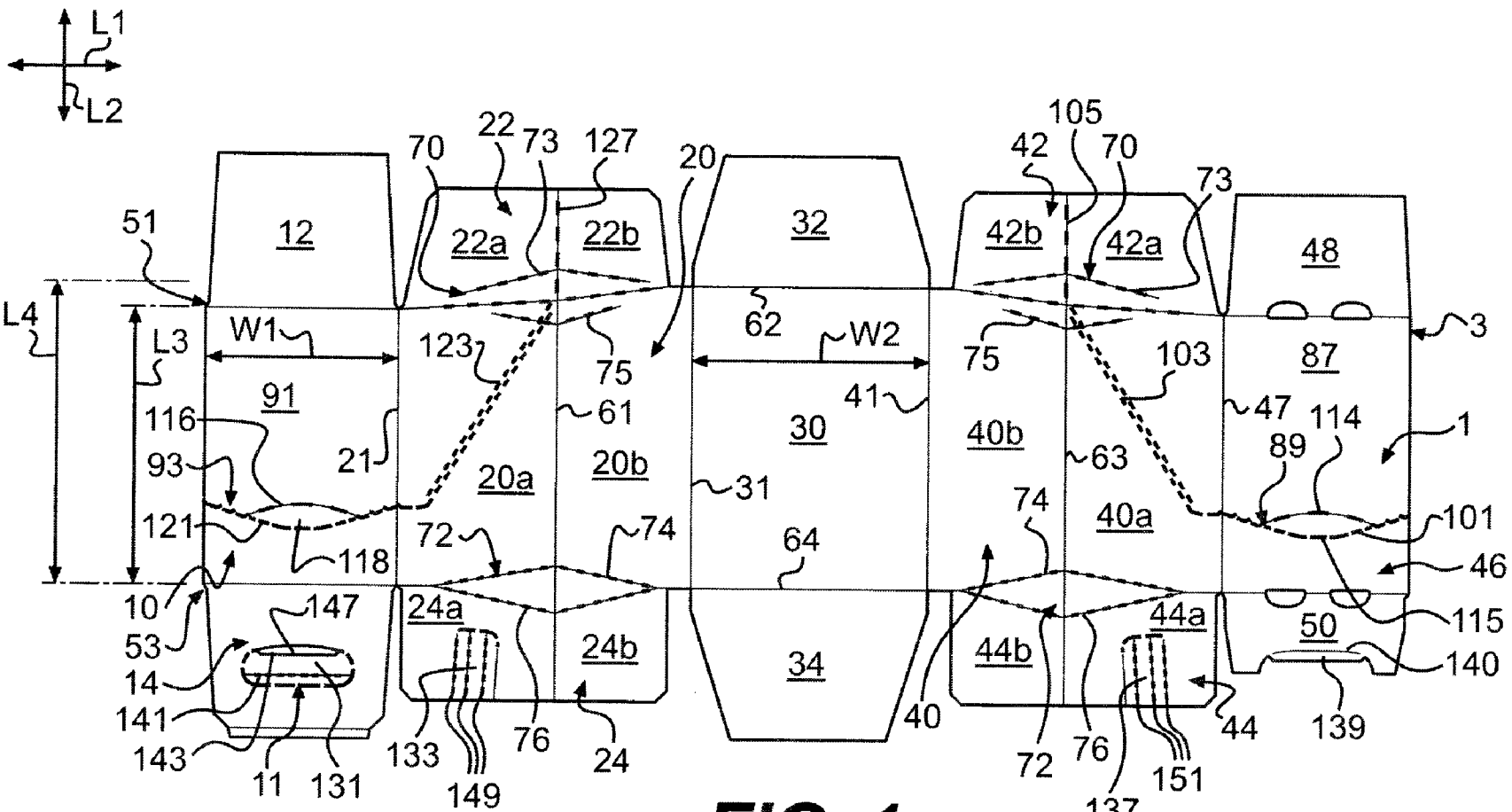
FIG. 1 is a plan view of a blank used to form a carton according to a first embodiment of the invention.
Figure 2:
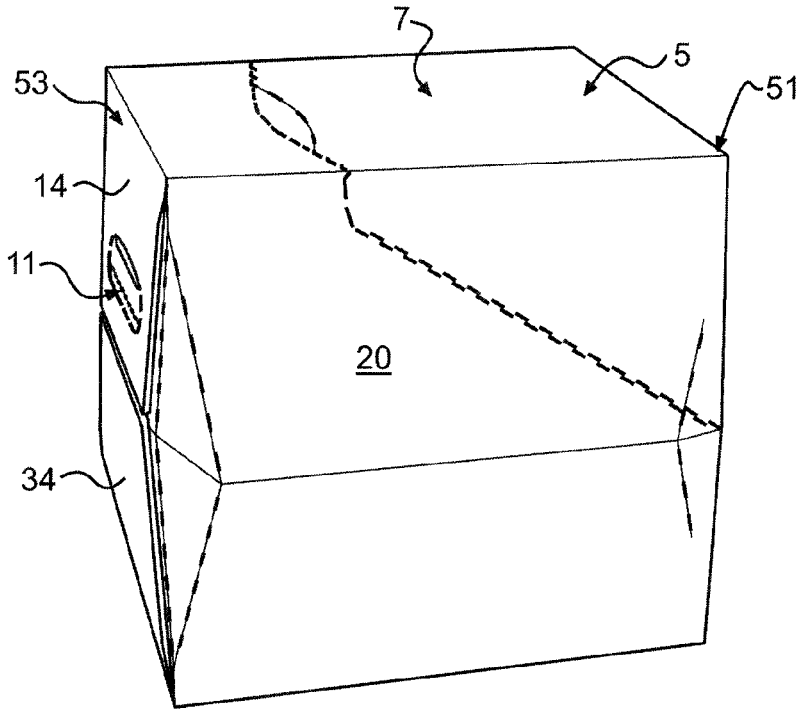
FIG. 2 is a perspective of the assembled and closed carton.
Figure 3:
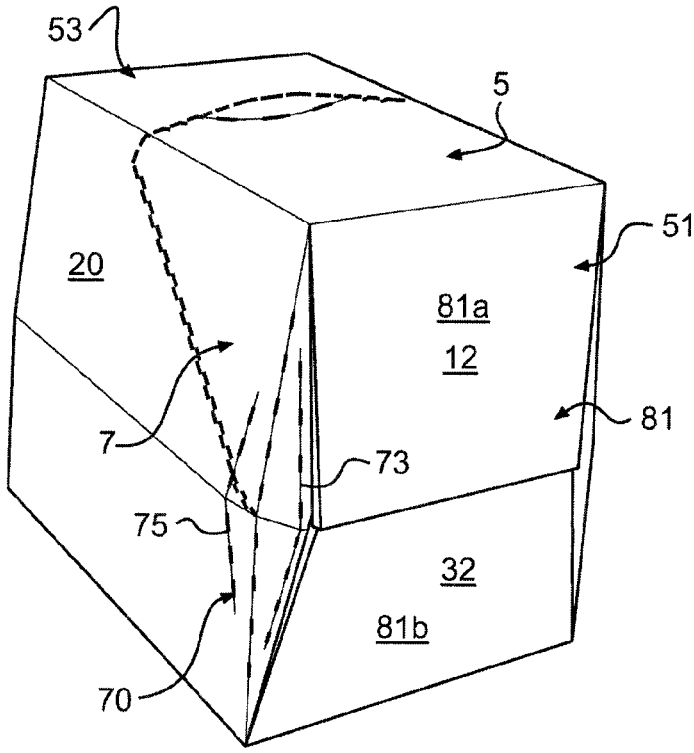
FIG. 3 is a perspective of the carton.
Figure 4:
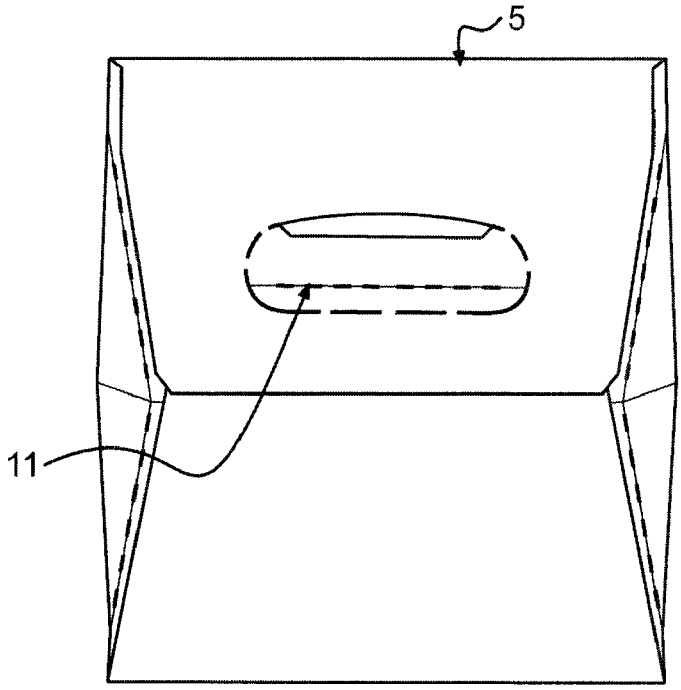
FIG. 4 is an end view of the carton.
Figure 5:
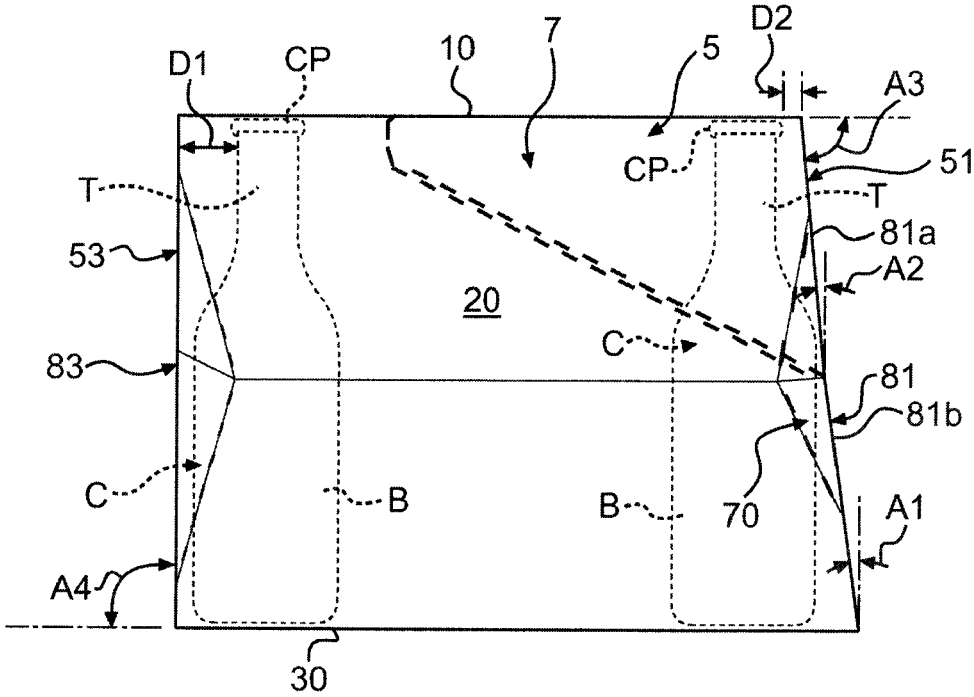
FIG. 5 is a side view of the carton.

FIG. 1 is a plan view of the exterior side 1 of a blank, generally indicated at 3, used to form a carton 5 (FIG. 2) according to the exemplary embodiment of the invention. The carton 5 can be used to house a plurality of articles such as containers C (FIG. 5). The carton 5 has a dispenser, generally indicated at 7 (FIG. 2), formed in the carton for allowing access to the containers C. In the illustrated embodiment, the containers C are bottles having a wide bottom B (FIG. 5) and a narrow top T including a cap CP. In the illustrated embodiment, the carton 5 is sized to house twelve containers C in a single layer in a 3×4 arrangement, but it is understood that the carton 5 may be sized and shaped to hold containers of a different or same quantity in more than one layer and/or in different row/column arrangements (e.g., 1×6, 3×6, 2×6, 2×6×2, 3×4×2, 2×9, 3×4, etc.). In the illustrated embodiment, the carton 5 includes a handle, generally indicated at 11 (FIG. 4), for grasping and carrying the carton.

The blank 3 has a longitudinal axis L1 and a lateral axis L2. In the illustrated embodiment, the blank 3 comprises a first top panel 10 foldably connected to a first side panel 20 at a first lateral fold line 21, a bottom panel 30 foldably connected to the first side panel 20 at a second lateral fold line 31, a second side panel 40 foldably connected to the bottom panel 30 at a third lateral fold line 41, and a second top panel 46 foldably connected to the second side panel 40 at a fourth lateral fold line 47.

The first top panel 10 is foldably connected to a first top end flap 12 and a second top end flap 14. The first side panel 20 is foldably connected to a first side flap 22 and a second side flap 24. The bottom panel 30 is foldably connected to a first bottom end flap 32 and a second bottom end flap 34. The second side panel 40 is foldably connected to a first side flap 42 and a second side flap 44. The second top panel 46 is foldably connected to a first top end flap 48 and a second top end flap 50. When the carton 5 is erected, the end flaps 12, 32, 48 and side flaps 22 and 42 close a first end 51 of the carton, and the end flaps 14, 34, 50 and side flaps 24 and 44 close a second end 53 of the carton. In accordance with an alternative embodiment of the present invention, different flap arrangements can be used for closing the ends 51, 53 of the carton 5.

The end flaps 12, 32, and 48 and side flaps 22 and 42 extend along a first marginal area of the blank 1, and are foldably connected at a first longitudinal fold line 62 that extends along the length of the blank. The end flaps 14, 34, and 50 and side flaps 24 and 44 extend along a second marginal area of the blank 1, and are foldably connected at a second longitudinal fold line 64 that also extends along the length of the blank. The longitudinal fold lines 62, 64 may be, for example, substantially straight, or offset at one or more locations to account for blank thickness or for other factors.

The blank 3 has a lateral fold line 61 extending across side flap 22, first side panel 20, and side flap 24 so that each of these flaps and panels may be folded along the fold line 61 to have an upper portion (respectively indicated 22*a*, 20*a*, 24*a*) that is foldably attached to a lower portion (respectively indicated 22*b*, 20*b*, 24*b*). A lateral fold line 63 extends across the side flap 42, second end panel 40, and side flap 44 so that each of these flaps and panels may be folded along the fold line 263 to have an upper portion (respectively indicated 42*a*, 40*a*, 44*a*) that is foldably attached to a lower portion (respectively indicated 42*b*, 40*b*, 44*b*).

The blank 3 includes two diamond-shaped corners, generally indicated at 70, at the first end 51 of the carton 5. The corners 70 allow the side panels 20, 40 and end panels 22, 42 to angle inward toward the interior of the carton 205. As shown in FIG. 1, each diamond-shaped corner 70 comprises opposed v-shaped fold lines 73, 75 spaced apart from the longitudinal fold line 62, and the v-shaped fold lines 73, 75 are respectively connected by the transverse fold lines 61, 63.

In the illustrated embodiment, the overlapped side end flaps 22, 42, top end flaps 12, 48, and bottom end flap 32 form an end wall 81 of the carton. The end wall 81 includes an upper portion 81*a* formed by the overlapped and adhered top end flaps 12, 48 which are adhered to the upper portions 22*a*, 42*a*of the side end flaps 22, 42. The end wall 81 includes a lower portion 81*b* formed by the overlapping and adhering the bottom end flap 32 to the lower portions 22*b*, 42*b* of the side end flaps 22, 42. As shown in FIG. 5, the lower portion 81*b* of the end wall is inclined toward the interior of the carton 5 at a first angle A1 and the upper portion of the end wall is inclined toward the interior of the carton at a second angle A2. This inclinations are relative to a vertical frame of reference that extends perpendicular to the horizontally extending top and bottom panels 10, 30. In the illustrated embodiment the first angle A1 is greater than the second angle A2, but in other embodiments the angles may be equal or the second angle may be less than the first angle without departing from the invention. In one embodiment, the first angle A1 is in the range of at least approximately 0-15 degrees, more preferably about 8 degrees, and the second angle A2 is in the range of at least approximately 0-10 degrees, more preferably about 3 degrees. The end wall 81 angles inward toward the interior of the carton 5 so that the base of the bottles B contacts or is closely adjacent to the lower portion 81*b* of the end wall and the cap CP of the bottles contacts or is closely adjacent the upper portion 81*a* of the end wall. This arrangement aids in securing the bottles B in the carton 5.

The blank 3 includes two diamond-shaped corners, generally indicated 72, at the second end 53 of the carton 5. The corners 72 are formed in a respective first side panel 20 and second side panel 40. The corners 72 cooperate with the longitudinal fold line 64 to respectively foldably connect the first and second side flaps 22, 44 to the first side panel 20 and second side panel 40. In the illustrated embodiment, each diamond-shaped corner 72 comprises opposed v-shaped fold lines 74, 76 that connect to the longitudinal fold line 64 at pointed corners of each diamond-shaped corner. The longitudinal fold lines 61, 63 respectively connect the v-shaped fold lines 74, 76 of the corners 72.

In the illustrated embodiment, the overlapped side end flaps 24, 44, top end flaps 14, 50, and bottom end flap 34 form an end wall 83 of the carton. As shown in FIG. 5, the end wall 83 is generally perpendicular to bottom panel 30 and top panels 10, 46 of the carton 5. The end wall 83 contacts or is closely adjacent the base of the bottles B at the end 53 of the carton 5. In contrast with the end wall 81, the end wall 83 is spaced apart from the cap CP and the narrow top T of the bottles C by a distance D1 (FIG. 5) that can advantageously ease usage of the handle 11.

Figure 8:
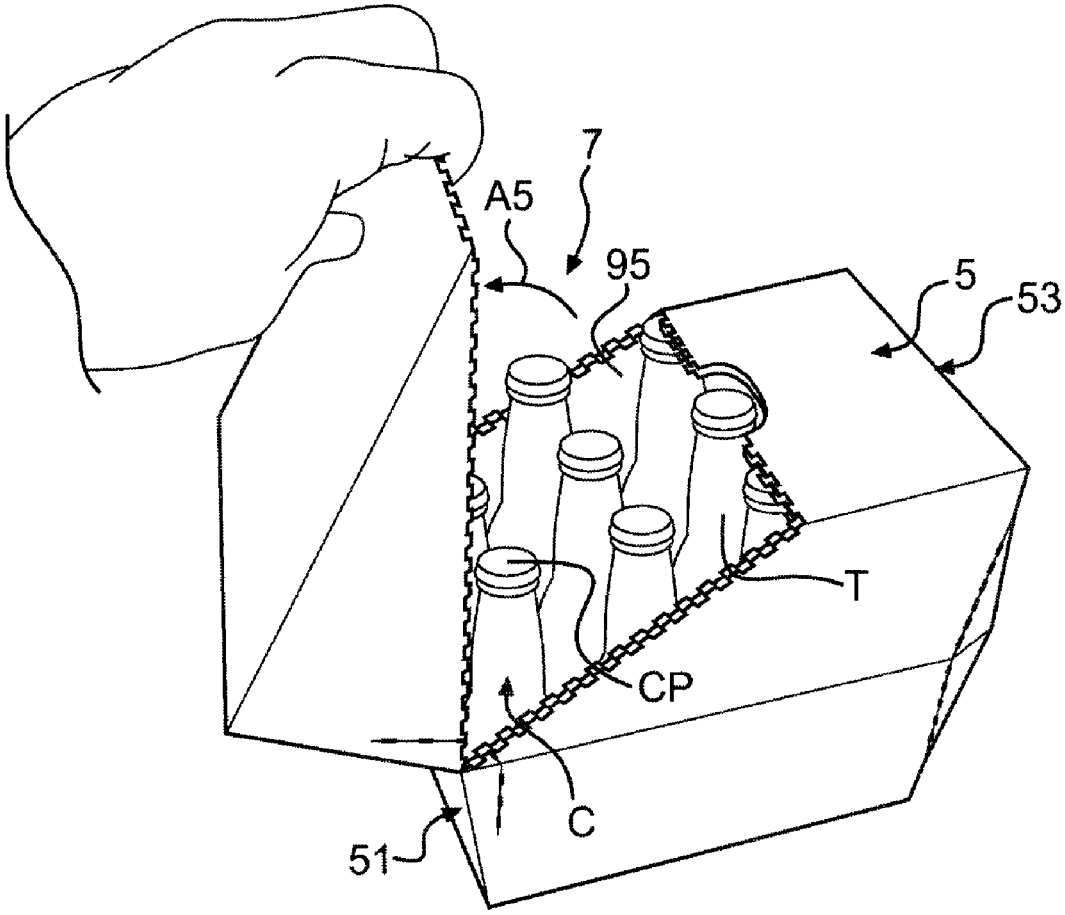
FIG. 8 is a perspective showing a dispenser panel in an opened configuration.

The dispenser 7 (FIG. 2) includes a first dispenser panel 87 (FIG. 1) removably attached to the blank 3 at a first tear line, generally indicated at 89, and a second dispenser panel 91 (FIG. 1) removably attached to the blank at a second tear line, generally indicated at 93. As shown in FIG. 8, the first dispenser panel 87 and the second dispenser panel 91 are separated from the assembled carton 5 at the first and second tear lines 89, 93 to form an opening 95 in the carton 5 to allow containers C to be removed from the carton. In the illustrated embodiment, the first tear line 89 includes a first portion 101 in the second top panel 46, a second portion 103 that is in the second side panel 40 and is oblique to the second top panel 46, and a third portion 105 extending across the diamond-shaped corner 70 in the second side panel and extending across the side flap 42. The first dispenser panel 87 includes a curved fold line 114 in the second top panel 46 that cooperates with the first portion 101 of the tear line 89 to form a finger panel 115 at the upper edge of the dispenser panel 87.

The second tear line 93 includes a first portion 121 in the first top panel 10, a second portion 123 that is in the first side panel 20 and is oblique to the first top panel, and a third portion 127 extending across the diamond-shaped corner 70 in the first side panel 20 and extending across the side flap 22. Also, the second dispenser panel 91 includes a curved fold line 116 in the first top panel 10 that cooperates with the first portion 121 of the second tear line 93 to form a finger panel 118 at the upper edge of the dispenser panel 91. It is understood that the dispenser panels 87, 91 could comprise other shapes and could include other panels or side and end flaps of the blank 3 without departing from the scope of this invention.

Figure 6:
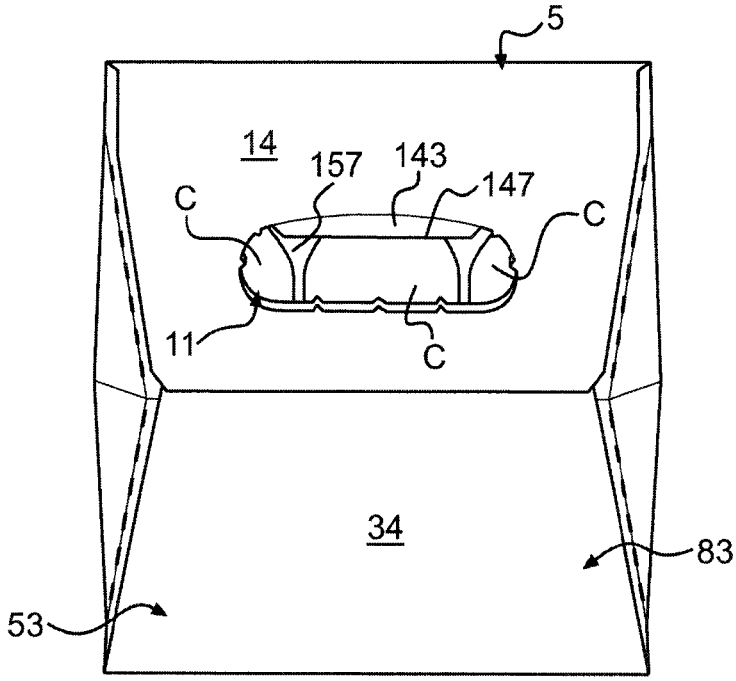
FIG. 6 is an end view similar to FIG. 4 but showing a handle activated.
Figure 7:
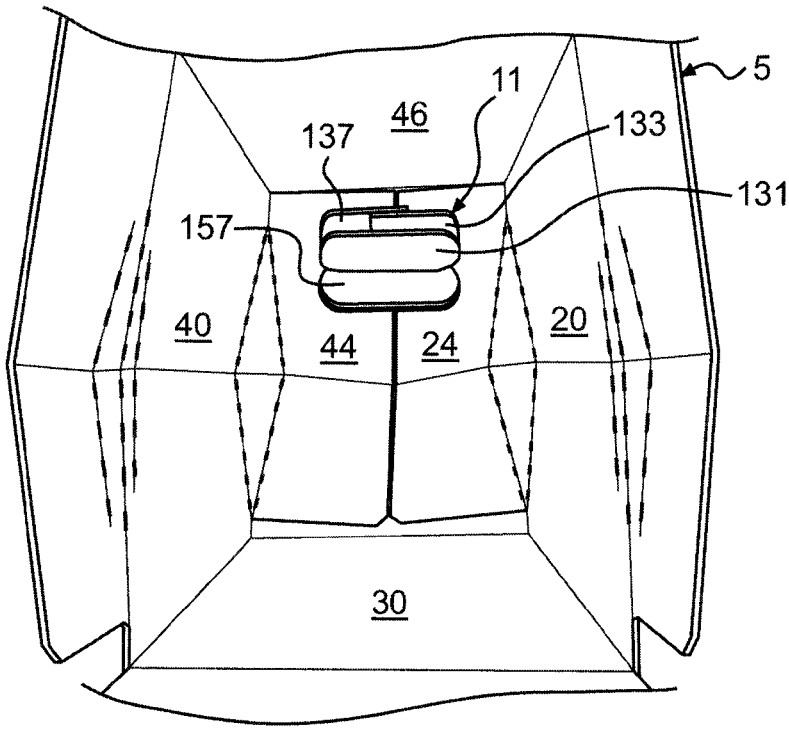
FIG. 7 is a view through an interior of the carton showing the handle activated.

As shown in FIG. 1, the handle 11 of the carton 5 includes a primary handle flap 131 formed in the second top end flap 14, a first secondary handle flap 133 formed in the second side end flap 24, a second secondary handle flap 137 formed in the second side end flap 44, and a reinforcing flap 139 foldaby attached to the second end flap 50 at a fold line 140. The primary handle flap 131 includes a longitudinal fold line 141 and an upper gripping panel 143 defined by a longitudinal fold line 147. The secondary handle flaps 133, 137 have three, generally parallel fold lines 149, 151 to facilitate forming the handle opening in the carton 5. As shown in FIGS. 4, 6, and 7, the primary handle flap 131, secondary handle flaps 133, 137, and reinforcing flap 139 are positioned in the blank 3 so that the flaps overlap in the assembled carton 5 so that the handle 11 may be activate by pressing on the handle flaps and folding the handle flaps inward to form an opening 157 (FIG. 7) in the carton 5. The opening 157 is shaped for insertion of a users fingers during grasping of the carton 5. The overlapped gripping panel 143 and reinforcing panel 139 are shaped to comfortably fit a users hand when inserted into the handle opening 157. Because the handle 11 is in the end wall 83 that is substantially perpendicular to the bottom panel 10, sufficient room (e.g., distance D1) exists for insertion of a user's fingers into the handle opening 157 and into the interior of the carton 5 typically without interference from the bottles C in the carton. It is understood that the flaps 131, 133, 137, 139 of the handle 11 could be otherwise shaped and arranged and the handle could includes various flaps, panels, etc., having other shapes and/or that only a single handle flap may be formed in the blank 3 without departing from the scope of this invention.

In accordance with the exemplary embodiment, the blank 3 can be erected into the carton 5 by folding along fold lines 21, 31, 41, 47, and adhering the first top panel 10 to the second top panel 46 to form a sleeve. It is understood that the blank 3 may be otherwise configured to have only one top panel or could have more than one bottom panel without departing from the scope of this invention. In the illustrated embodiment, the first end 51 of the carton 5 is closed by respectively overlapping and adhering the end flaps 12, 32, 48 and side flaps 22, 42 after the containers C are inserted into the carton. The second end 53 of the carton 5 is closed by respectively overlapping the end flaps 14, 34, 50 and side flaps 24, 44. Once the blank 3 is formed into a sleeve, the containers C may be loaded in the carton 5 from the first end 51 and then the first end may be closed by overlapping and gluing the end flaps 12, 32, 48 and side flaps 22, 42. Also, other closing and loading sequences may be used without departing from the invention.

The carton 5 of the present invention is shaped to hold bottles C in an upright position such that the bottom B of the bottles is supported by the bottom panel 30 and the top portion T of the bottles is in contact with or adjacent to the overlapped first and second top panels 10, 46. The bottom panel 30 has a width W2 greater than a width W1 of the first top panel 10 so that the side walls 20, 40, of the assembled carton 5 are inwardly tapered such that the bottom of each side wall contacts, or is closely adjacent, the bottom B (FIG. 2) of a respective container C and the top of each side wall contacts, or is closely adjacent, the cap CP of a respective container. The diamond-shaped corners 70, 72 of the carton 5 allow the top portion 20*a*, 40*a*of each sidewall 20, 40 to be angled inward so that the carton 5 is more narrow at the top where the side walls connect with the overlapped top walls 10, 46 than at the bottom where the side walls connect with the bottom panel 30. This narrowing of the width of the carton 5 from the bottom to the top provides two points of contact of the side walls 20, 40 with the bottles C to hold both the top T and the bottom B of the bottles in a relatively fixed position to restrict movement of the bottles in the carton.

Also, the bottom panel 30 has a length L4 greater than a length L3 of the first top panel 10. The greater length L4 of the bottom panel 30 allows the end wall 81 at the first end 51 of the carton to taper inward towards the interior of the carton 5 in the manner described herein.

In one exemplary embodiment and as best understood with reference to FIG. 1, the width W1 of the first top panel 10 is approximately 6.1 inches (155 mm) and the width W2 of the bottom panel 30 is approximately 7.3 inches (185 mm). In general, the ratio of the width W1 of the top panel 10 to the width W2 of the bottom panel 30 can range from approximately 0.7 to 1, and this ratio will typically be based on the geometry of the containers C housed in the carton and may vary accordingly.

In one exemplary embodiment, and as best understood with reference to FIG. 1, the length L4 of the bottom panel 30 is approximately 9-¾ inches (248 mm) and the length L3 of the first top panel is approximately 9 inches (229 mm). In general the ratio of the length L3 of the top panel 10 to the length L4 of the bottom panel 30 can range from approximately 0.7 to 1, and this ratio will typically be based on the geometry of the containers C housed in the carton and may vary accordingly.

The first dispenser panel 87 and the second dispenser panel 91 are overlapped in the assembled carton 5 so that the dispenser 5 is opened by separating the first and second dispenser panels along the tear lines 89, 93. As shown in FIG. 8, an exemplary opening process can begin with pressing against the finger panels 115, 118 to tear the dispenser panels 87, 91 along the curved tear lines 101, 121 and folding the finger panels inward along the fold lines 114, 116. Once the finger panels 115, 118 are folded inward, the dispenser panels 87, 91 are grasped and pulled in the direction of arrow A3 (FIG. 8) to tear the carton 5 along the tear lines 89, 93. The dispenser panels 87, 91 may be removed from the carton 5 by completely tearing the panels along the tear lines 89, 93. Containers C are positioned in the upright position in the carton 5 so that the removal of the dispenser panels 87, 91 exposes the top portion T of the containers for grasping by a user to selectively remove a container through the opening 95 in the carton 5. It is understood that the dispenser 7 may be otherwise sized and shaped to correspond with various other sizes and shapes of containers C which may be housed in the carton 5, and to form other sizes and locations of the opening. For example, the two dispenser panels 87, 91 and two tear lines 89, 93 could be combined or replaced with a single dispenser panel and tear line without departing from the scope of this invention.

As shown in FIGS. 4, 6, and 7, the handle 11 may be used to grasp the carton 5 by pressing against the overlapped handle flaps 131, 133, 137 to create the elongate opening 157 in the end wall 83 at the second end 53 of the carton. The handle 11 is shaped so that multiple fingers of a user may be placed in the elongate opening 157 for grasping and carrying the carton 5.

In accordance with the exemplary embodiments, features that can be characterized as being related to promoting the easy use of the handle 11 can be described in different ways. For example, at least a portion of the first end panel 81 extends downwardly from the top panel 10 at a first angle A3 (FIG. 5) so that a first distance D2 is defined between an upper edge of the first end panel and tops CP of containers C of the plurality of containers that are adjacent to the upper edge of the first end panel. At least a portion of the second end panel 83 extends downwardly from the top panel 10 at a second angle A4 so that a second distance D1 is defined between an upper edge of the second end panel and tops CP of adjacent containers C of the plurality of containers that are adjacent to the upper edge of the second end panel. The second angle A4 is greater than the first angle A3 and the second distance D1 is greater than the first distance D2 and a distance (e.g., approximately D1) is defined between the handle 11 in the end panel 83 and at least one container C of the plurality of containers that is adjacent to the handle. The distance between the handle 11 and the at least one adjacent container C is for facilitating ease of use of the handle. In one embodiment, the first angle A3 is less than approximately 90 degrees and the second angle A4 is substantially 90 degrees.

The blank according to the present invention can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, fold lines can include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like. For example, a cut line can be a continuous slit or could be wider than a slit without departing from the present invention.

The above embodiments may be described as having one or more panels adhered together by glue during erection of the carton embodiments. The term "glue" is intended to encompass all manner of adhesives commonly used to secure carton panels in place.

The foregoing description of the invention illustrates and describes various embodiments of the present invention. As various changes could be made in the above construction without departing from the scope of the invention, it is intended that all matter contained in the above description or shown in the accompanying drawings shall be interpreted as illustrative and not in a limiting sense. Furthermore, the scope of the present invention covers various modifications, combinations, alterations, etc., of the above-described embodiments that are within the scope of the claims. Additionally, the disclosure shows and describes only selected embodiments of the invention, but the invention is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the invention without departing from the scope of the invention.

What is claimed is:

1. A carton containing a plurality of containers, comprising:

a plurality of panels extending at least partially around an interior of the carton, wherein the plurality of panels includes a top panel;

opposite first and second end panels that respectively at least partially close opposite ends of the carton;

a handle that is positioned in the second end panel and is for use in carrying the carton, wherein at least a portion of the first end panel extends downwardly from the top panel at a first angle and a first distance is defined between an upper edge of the first end panel and tops of containers of the plurality of containers that are adjacent to the upper edge of the first end panel, at least a portion of the second end panel extends downwardly from the top panel at a second angle and a second distance is defined between an upper edge of the second end panel and tops of adjacent containers of the plurality of containers that are adjacent to the upper edge of the second end panel, and the second angle is greater than the first angle and the second distance is greater than the first distance and a distance is defined between the handle and at least one container of the plurality of containers that is adjacent to the handle, and the distance between the handle and the at least one adjacent container is for facilitating ease of use of the handle.

2. The carton containing the plurality of containers according to claim 1 wherein the distance between the handle and the at least one adjacent container is approximately equal to the second distance that is defined between the upper edge of the second end panel and the tops of the containers that are adjacent to the upper edge of the second end panel.

3. The carton containing the plurality of containers according to claim 1, wherein:

the first angle is less than approximately 90 degrees, the second angle is substantially 90 degrees, the plurality of panels includes a bottom panel, the first end panel comprises a plurality of first flaps, at least one first flap of the plurality of first flaps extends upwardly from the bottom panel so that an acute angle is defined between the at least one first flap and the bottom panel, the second end panel comprises a plurality of second flaps, and at least one second flap of the plurality of second flaps extends upwardly from the bottom panel so that an angle that is substantially 90 degrees is defined between the at least one second flap and the bottom panel.

4. A carton for containing a plurality of articles, the carton comprising:

panels that extend at least partially around an interior of the carton, the panels comprise a top panel, a bottom panel, a first side panel, and a second side panel;

at least two end flaps respectively foldably attached to respective panels of the plurality of panels, wherein the end flaps at least partially form a closed end of the carton;

a dispenser for allowing access to the articles in the carton, the dispenser comprising a dispenser panel that is at least partially defined by a tear line in the carton and is for being at least partially removed for at least further opening a dispenser opening in the closed end, the tear line comprising a first portion in the top panel extending between the first and second side panels, a second portion in the first side panel, a third portion in the second side panel, a fourth portion in one of the at least two end flaps, and a fifth portion in another of the at least two end flaps, with at least one of the second and third portions of the tear line being oblique relative to the top panel, wherein the closed end of the carton comprises an end wall that angles inward toward the interior of the carton.

5. The carton of claim 4 wherein the at least two end flaps comprise a first side end flap having an upper portion and a lower portion, the lower portion angles inward toward the interior of the carton at a first angle relative to a vertical axis of the carton and the upper portion angles inward toward the interior of the carton at a second angle relative to the vertical axis of the carton.

6. The carton of claim 5 wherein the second angle is greater than the first angle.

7. The carton of claim 4 wherein:

the end is a first end;

the end flaps are first end flaps that are overlapped with respect to one another to form the closed first end; and the carton further comprises at least two second end flaps respectively foldably attached to respective panels of the plurality of panels that are overlapped with respect to one another to form a closed second end of the carton.

8. The carton of claim 4 wherein the dispenser panel comprises a finger tab foldably attached to the top panel for grasping the dispenser panel and opening the dispenser.

9. The carton of claim 4 in combination with a plurality of articles, the plurality of articles comprising bottles that are arranged in an upright position in the carton for removal through the dispenser opening of the dispenser.

10. The carton of claim 4 wherein the top panel has a width less than a width of the bottom panel.

11. The carton of claim 10 wherein the top panel has a length less than a length of the bottom panel.

12. The carton of claim 4 wherein the first side panel comprises a first upper portion foldably attached to a first lower portion and the second side panel comprises a second upper portion foldably attached to a second lower portion.

13. The carton of claim 4, wherein the at least two end flaps comprises a first side end flap foldably connected to the first side panel and a second side end flap foldably connected to the second side panel, wherein the fourth portion of the tear line extends in the first side end flap and the fifth portion of the tear line extends in the second side end flap.

14. A carton for containing a plurality of articles, the carton comprising:

panels that extend at least partially around an interior of the carton, the panels comprise a top panel, a bottom panel, a first side panel, and a second side panel;

at least two first end flaps respectively foldably attached to respective panels of the plurality of panels, wherein the first end flaps at least partially form a closed first end of the carton;

at least two second end flaps respectively foldably attached to respective panels of the plurality of panels, wherein the second end flaps at least partially form a closed second end of the carton; and a dispenser for allowing access to the articles in the carton, the dispenser comprising a dispenser panel that is at least partially defined by a tear line in the carton and is for being at least partially removed for at least further opening a dispenser opening in the closed end, the tear line comprising a portion in at least one of the side panels that is oblique relative to the top panel, wherein the closed first end of the carton comprises a first end wall that angles inward toward the interior of the carton, and wherein the closed second end comprises an end wall that is substantially perpendicular to the bottom panel of the carton, and the carton further comprises a handle for grasping and carrying the carton, the handle comprising a handle flap foldably attached to at least one of the second end flaps.

15. The carton of claim 14 wherein the at least two second end flaps comprise a top end flap foldably attached to the top panel, a first side end flap foldably attached to the first side panel, and a second side end flap foldably attached to the second side panel, and the handle flap is a primary handle panel flap attached to the top end panel, and the carton further comprises a first secondary handle flap foldably attached to the first side end flap and a second secondary handle flap foldably attached to the second side end flap.

16. The carton of claim 15 wherein the top panel is a first top panel, the top end flap is a first top end flap, the plurality of panels comprises a second top panel, the at least two second end flaps comprise a second top end flap foldably attached to the second top panel, and the handle comprises a reinforcing panel foldably attached to the second top panel.

17. A blank for forming a carton for containing a plurality of articles, the blank comprising:

a plurality of panels comprising a top panel, a bottom panel, a first side panel, and a second side panel;

at least two first end flaps respectively foldably attached to respective panels of the plurality of panels, wherein the first end flaps are for forming a closed first end of the carton formed from the blank;

at least two second end flaps respectively foldably attached to respective panels of the plurality of panels, wherein the second end flaps are for forming a closed second end of the carton formed from the blank;

a handle flap foldably attached to at least one of the second end flaps; and a dispenser panel that is at least partially defined by a tear line in the blank and is for being at least partially removed for at least further opening a dispenser opening in the carton formed from the blank, the tear line comprising a portion in at least one of the side panels that is oblique relative to the top panel in the carton formed from the blank, wherein the at least two first end flaps are for forming a first end wall that angles inward from the bottom panel to the top panel, and the second end flaps are for forming a second end wall at the second end that is substantially perpendicular to the bottom panel.

18. The blank of claim 17 wherein the at least two end flaps each have an upper portion foldably attached to a lower portion, the lower portion angles inward at a first angle relative to a vertical axis of the carton and the upper portion angles inward at a second angle relative to the vertical axis of the carton, the second angle is greater than the first angle.

19. The blank of claim 17 wherein the at least two second end flaps comprise a top end flap foldably attached to the top panel, a first side end flap foldably attached to the first side panel, and a second side end flap foldably attached to the second side panel, and the handle flap is a primary handle panel flap attached to the top end panel, the blank further comprises a first secondary handle flap foldably attached to the first side end flap and a second secondary handle flap foldably attached to the second side end flap.

20. The blank of claim 19 wherein the top panel is a first top panel, the top end flap is a first top end flap, the plurality of panels comprises a second top panel, the at least two second end flaps comprise a second top end flap foldably attached to the second top panel, and the blank further comprises a handle reinforcing panel foldably attached to the second top panel.

21. The blank of claim 17 wherein the tear line comprises a first portion in the top panel extending between the first and second side panels, a second portion in the first side panel, and a third portion in the second side panel, with at least one of the second and third portions of the tear line being oblique relative to the top panel.

22. The blank of claim 17 wherein the top panel has a width less than a width of the bottom panel, and the top panel has a length less than a length of the bottom panel.

* * * * *